US007648384B2

(12) United States Patent
Desissard et al.

(10) Patent No.: US 7,648,384 B2
(45) Date of Patent: Jan. 19, 2010

(54) TIGHTLY SEALED ELECTRICAL HOOK-UP DEVICE WITH MULTIPLE CONFIGURATIONS

(75) Inventors: Olivier Desissard, Saint-Jouvent (FR); Sébastien Dupuy, Saint-Yrieix la Perche (FR)

(73) Assignees: Legrand France, Limoges (FR); Legrand SNC, Limoges (FR)

( * ) Notice: Subject to any disclaimer, the term of this patent is extended or adjusted under 35 U.S.C. 154(b) by 0 days.

(21) Appl. No.: 12/116,530

(22) Filed: May 7, 2008

(65) Prior Publication Data

US 2008/0280480 A1 Nov. 13, 2008

(30) Foreign Application Priority Data

May 11, 2007 (FR) ..... 07/03418

(51) Int. Cl.
*H01R 13/62* (2006.01)

(52) U.S. Cl. ..... 439/367; 174/67

(58) Field of Classification Search ..... 439/367, 439/271, 272; 174/67
See application file for complete search history.

(56) References Cited

U.S. PATENT DOCUMENTS 4,424,407 A * 1/1984 Barbic ..... 174/67
4,576,428 A 3/1986 DeLuca et al.
4,917,617 A * 4/1990 Smith ..... 439/135
5,527,993 A * 6/1996 Shotey et al. ..... 174/67
5,589,665 A * 12/1996 Scamacca ..... 174/67
6,198,046 B1 * 3/2001 Moodie ..... 174/67
6,462,277 B1 * 10/2002 Young et al. ..... 174/66
7,241,952 B2 * 7/2007 Dinh ..... 174/67

FOREIGN PATENT DOCUMENTS

EP 1 251 600 A 10/2002
FR 2 823 603 A1 10/2002
GB 2 269 485 A 2/1994
GB 2 307 600 A 5/1997

* cited by examiner

*Primary Examiner*—Edwin A. Leon
*Assistant Examiner*—Vanessa Girardi
(74) *Attorney, Agent, or Firm*—Miles & Stockbridge P.C; Eric G. King

(57) ABSTRACT

An electrical hook-up device including an outlet, a plug and a tight-seal casing with a cover and a shutter and enabling a tightly sealed hook-up of the plug in the outlet. The casing takes the form of an accessory removably mounted on the outlet, and the shutter of said casing is also movably mounted on the cover.

4 Claims, 3 Drawing Sheets

TIGHTLY SEALED ELECTRICAL HOOK-UP DEVICE WITH MULTIPLE CONFIGURATIONS

BACKGROUND

1. Field of Invention

The invention relates in general to the field of electrical appliances.

2. General Background

More specifically, the invention relates to an electrical hook-up device with multiple configurations, including an outlet having a front face and a plug equipped with an electrical cord, wherein the front face of the outlet is equipped with a tight-seal casing selectively enabling a tight hook-up between the plug and said outlet and including a shutter and a cover with an opening sized so as to allow the plug to pass through, wherein the shutter is mobile between two positions, open and closed, in which it respectively frees the opening of the cover and closes it in a tightly sealed manner, and the casing includes two seals respectively installed on the cover and on the shutter and cooperating so as to hold the cord in a tightly sealed manner when the shutter is in the closed position.

Such a device is known to a person skilled in the art in particular from patent document FR 2 823 603.

With this device, it is possible to seal an outlet in which a plug is engaged without having to unplug the plug or to disassemble the cord from the plug.

Nevertheless, this known device has a specific structure, so that the sealing function that it satisfies is available only in the location where said device has been provided and mounted.

The present invention, which is used in this context, is intended to overcome this constraint.

SUMMARY

To this end, the device of the invention, which is moreover consistent with the general definition provided in the preamble above, is characterized essentially in that the casing takes the form of an accessory selectively removably mounted on the front face of the outlet, and in that the shutter is movably mounted on the cover of the casing.

With this arrangement, it becomes possible to confer a sealing function on a device that has not in principle had this function.

The hook-up device of the invention can also include a cover attached in a tightly sealed manner on the front face of the outlet and having a base on which the casing is removably mounted.

In this case, it is possible for the casing to have a base separate from the seals, and for said base and the base of the cover to have a cylindrical shape and to have respective and complementary reliefs, together forming a bayonet connection that enables them to be coupled.

The base of the cover, for example, projects and has an internal diameter greater than the external diameter of the base of the casing.

In addition, the cover can be removably mounted on the front face of the outlet.

Moreover, the shutter is, for example, pivotably mounted on the cover around an axis substantially parallel to the front face, and can partially extend in a direction perpendicular to said front face.

BRIEF DESCRIPTION OF THE DRAWINGS

Other features and advantages of the invention will become clear from the following description provided for indicative and non-limiting purposes, in reference to the appended drawings, in which:

FIG. 1 is a perspective view of an outlet intended to be equipped so as to form a device according to the invention with;

DETAILED DESCRIPTION

Figure 1:
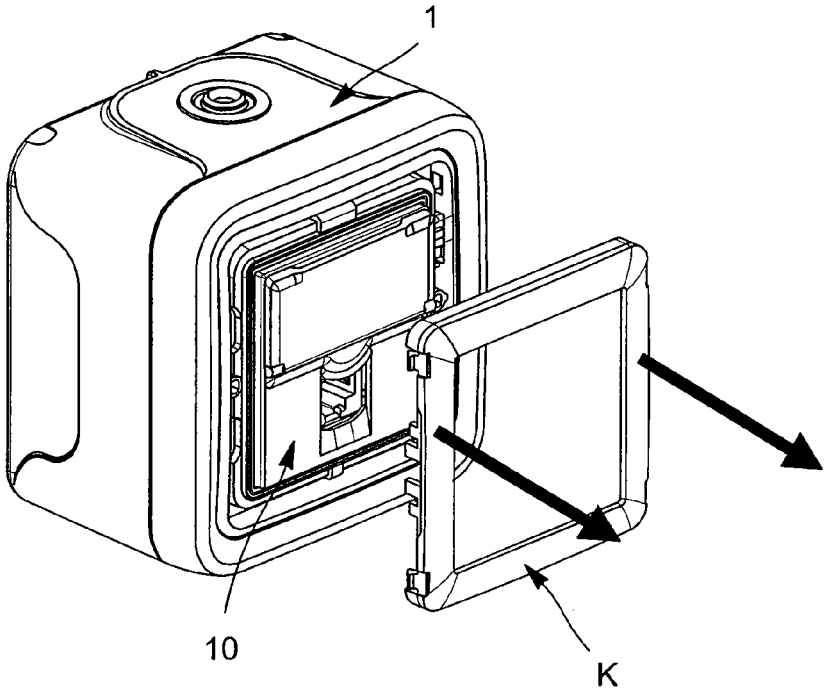

As mentioned above, the invention relates to an electrical hook-up device with multiple configurations.

The term "electrical hook-up device" refers in this document to a device making it possible to ensure, as desired, electrical continuity between at least two portions of a non-continuous electrical conductor, whether said conductor is intended to transport an electrical power or simply to transport a low-power electrical signal, such as a computer data signal.

This device includes, in a manner known per se from the aforementioned patent document, an outlet 1, a plug 2, and a tight-seal casing 3.

The outlet 1 has a front face 10 in which the plug 1, which is equipped with an electrical cord 20, can be connected.

The tight-seal casing 3, which is provided on the front face 10 of the outlet 1, makes it possible to ensure, with respect to the outside of the casing, the tightness, at least with respect to dust, of the hook-up between the plug 2 in the outlet 1.

This casing 3 essentially includes a shutter 31 and a cover 32, which cover 32 has an opening 320 that is sized so as to enable the plug 2 to pass through.

Figure 4:
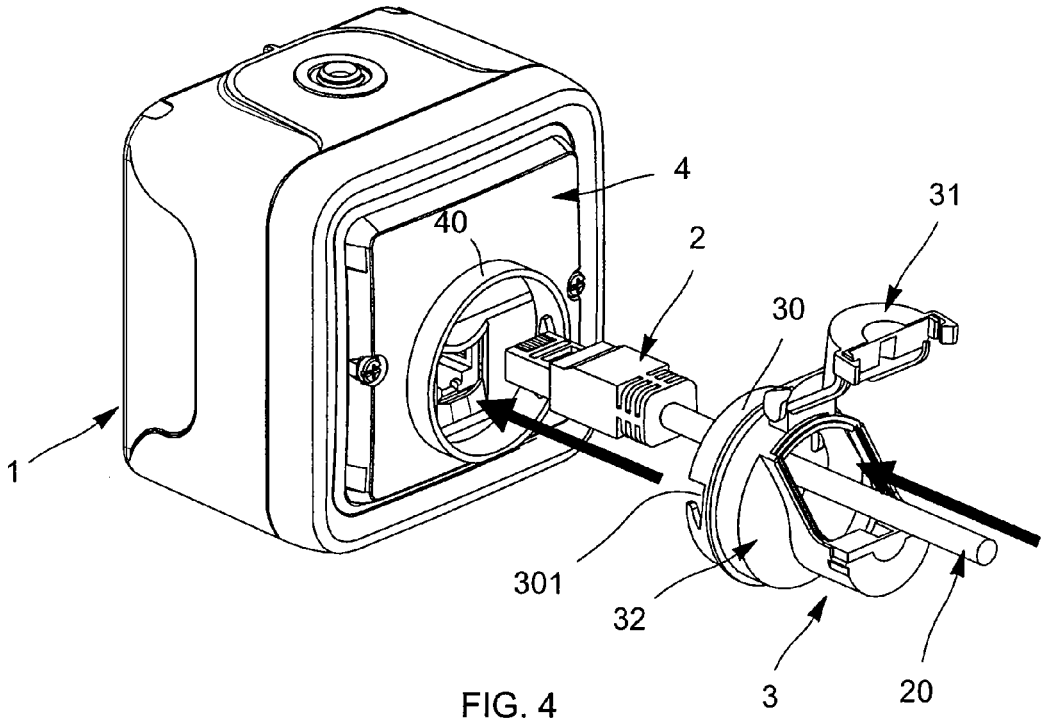
FIG. 4 is an exploded perspective view of a device according to the invention, shown at the beginning of a hook-up operation.
Figure 5:
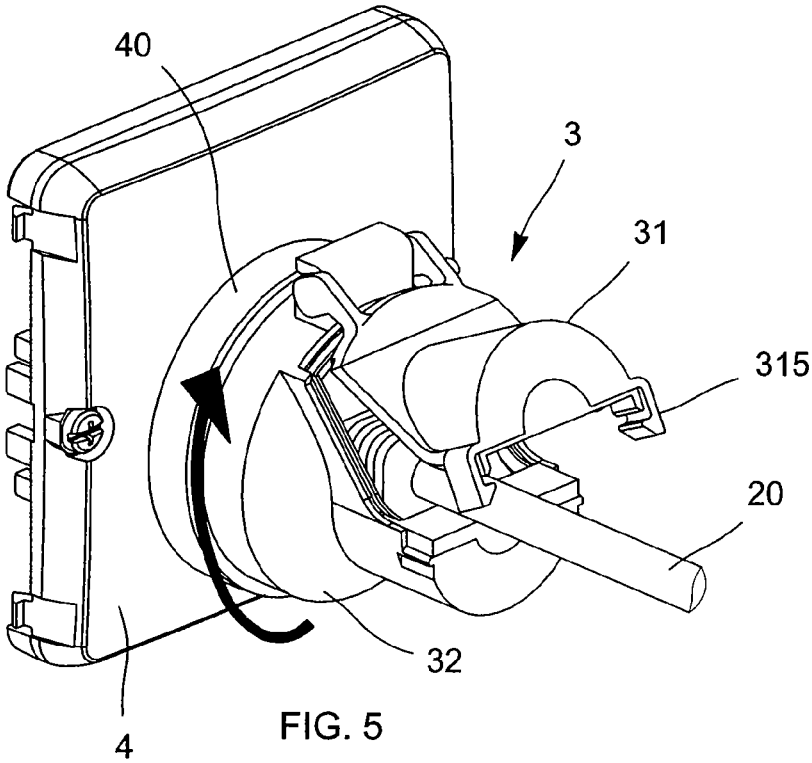
FIG. 5 is a partial perspective view of a device according to the invention, shown during a hook-up operation.
Figure 6:
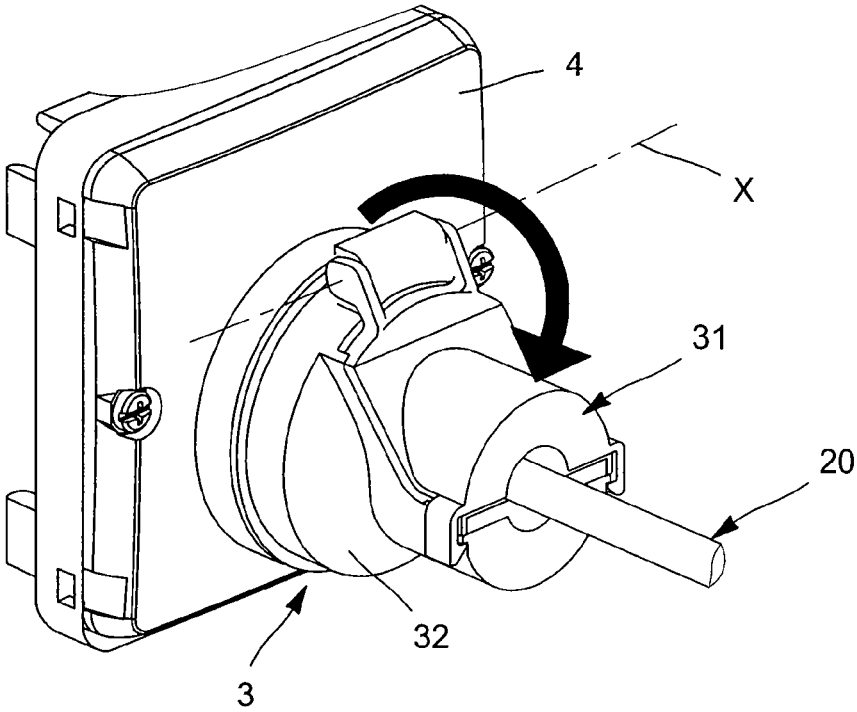
FIG. 6 is a partial perspective view of a device according to the invention, shown at the end of a hook-up operation.

The shutter 31 is movably mounted between an open position shown in particular in FIG. 4 and in which it frees the opening 320 of the cover 32, and a closed position shown in FIG. 6, in which said shutter 31 closes said opening 320 in a tightly sealed manner.

To do this, the casing 3 includes two seals, of which one 321 is installed on the cover 32 and the other 311 is installed on the shutter 31, which seals 321 and 311 cooperate so as to hold the cord 20 in a tightly sealed manner when the shutter 31 is in the closed position.

Figure 3:
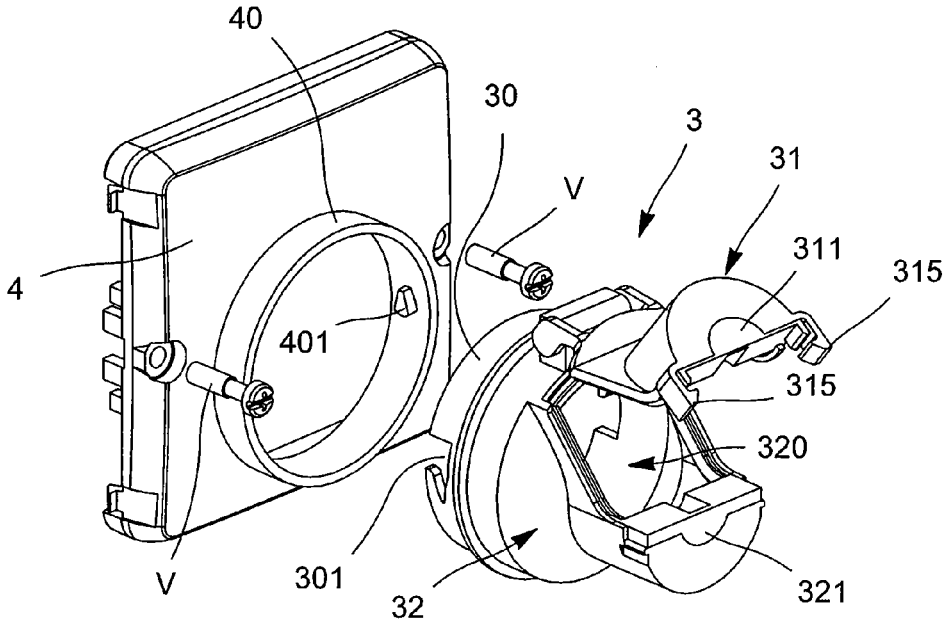
FIG. 3 is a perspective view of a sub-assembly of a device according to the invention.

According to the invention, and as shown in particular in FIGS. 3 and 4, the casing 3 takes the form of an accessory that is removably mounted on the front face 10 of the outlet 1, and the shutter 31 is movably mounted on the cover 32 of the casing 3.

As shown in FIG. 1, an outlet 1 capable of being equipped so as to constitute a device according to the invention can, before being thus equipped, comprise an aesthetic cover K removably mounted on the front face 10 of the outlet.

When this outlet is installed, the cover can be removed and replaced by a cover 4, itself removably attached, for example by means of a screw V, on the front face 10 of the outlet 1, in which the tightness between the front face 10 and the cover is ensured by means of standard seals.

As shown in particular in FIGS. 3 to 6, the cover 4 has a base 40 on which the casing 3 is itself removably mounted in a tightly sealed manner, at least to dust.

To do this, the casing 3 has, at a distance from the seals 321 and 311, a base 30 that, like the base 40 of the cover 4, has a cylindrical shape.

The base 30 of the casing 3 and the base 40 of the cover 4 have respective and complementary reliefs 301 and 401 that together form a bayonet connection making it possible to couple the casing 3 and the cover 4.

If the reliefs 301 borne by the base 30 of the casing are female reliefs, it may be appropriate for the base 40 of the cover 4 to project and have an internal diameter greater than the external diameter of the base 30 of the casing 3 so that after the coupling of the casing 3 and the cover 4, the base 30 of the casing and the female reliefs 301 are protected inside the base 40.

As shown in FIG. 6, the shutter 31 is preferably pivotably mounted on the cover 32 about an axis X substantially parallel to the front face 10, and said shutter partially extends in a direction perpendicular to this front face 10, i.e. in the direction of the cord 20 as shown in this figure.

FIGS. 2 and 4 to 6 show the sequence of operations making it possible to transform an outlet 1 as shown in FIG. 1 into a device according to the invention.

Figure 2:
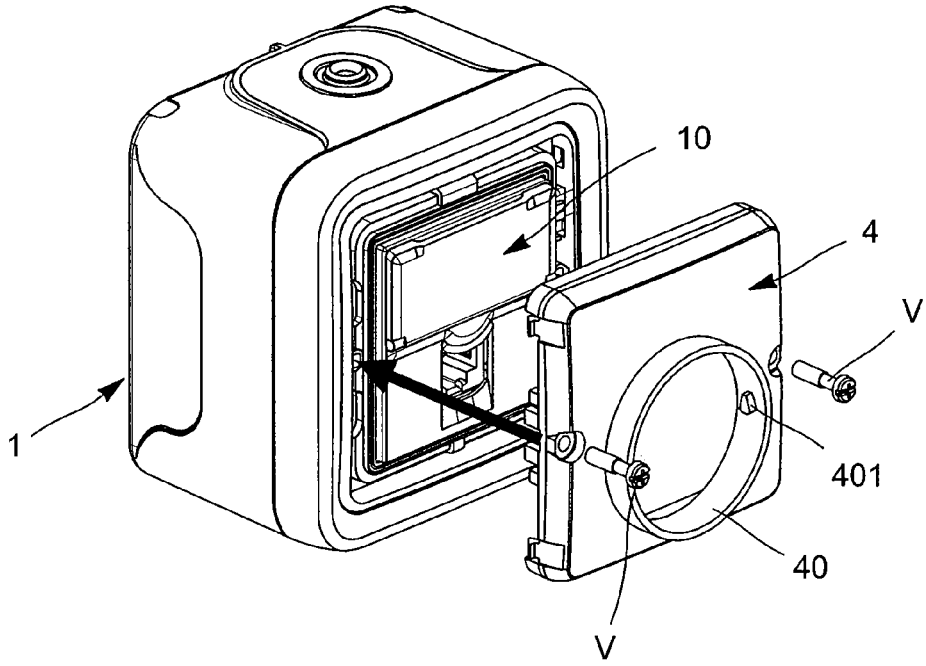
FIG. 2 is a perspective view of the outlet shown in FIG. 1, shown at the beginning of an installation phase intended to transform it into a device according to the invention.

To do this, the cover 4, after removal of the aesthetic cover K (FIG. 1), is mounted on the front face 10 of the outlet 1 (FIG. 2).

Then (FIG. 4), the plug 2, and the cord 20 with which it is equipped, pass through the opening 320 of the casing 3, of which the shutter 31 has previously been placed in the open position.

The casing 3 and the cover 4 are then coupled (FIG. 5) at the level of the base 30 of the first and the base 40 of the second.

Finally (FIG. 6), the shutter 31 is placed on the opening 320 that it closes, and is snapped on the cover 32 with snap-in catches 315.

As a person skilled in the art can easily understand on reading this description, the operations described above can be performed in reverse so as to return to the initial state as shown in FIG. 1.

What is claimed is:

1. An electrical hook-up device with multiple configurations, comprising:

an outlet having a front face and a plug equipped with an electrical cord, wherein the front face of the outlet is equipped with a tight-seal casing selectively enabling a tight hook-up between the plug and said outlet and including a shutter and a cover with an opening sized so as to allow the plug to pass through, wherein the shutter is moveable between two positions, the positions being open and closed, in which the shutter respectively frees the opening of the cover and closes the cover in a tightly sealed manner, and the casing includes first and second seals respectively installed on the cover and on the shutter and cooperating so as to hold the cord in a tightly sealed manner when the shutter is in the closed position, wherein the casing comprises an accessory selectively removably mounted on the front face of the outlet, and wherein the shutter is movably mounted on the cover of the casing, wherein the electrical hook-up device further comprises a face cover attached in a tightly sealed manner on the front face of the outlet and having a face base on which the casing is removably mounted, and wherein the casing has a casing base separate from the seals, and wherein the casing base and the face base of the cover each have a cylindrical shape and respective and complementary reliefs, together forming a bayonet connection that enables the casing base and the face base to be coupled.

2. The electrical hook-up device according to claim 1, wherein the face base of the cover projects and has an internal diameter greater than an external diameter of the casing base of the casing.

3. The electrical hook-up device according to claim 1, wherein the cover is removably mounted on the front face of the outlet.

4. The electrical hook-up device according to claim 1, wherein the shutter is pivotably mounted on the cover around an axis (X) substantially parallel to the front face, and partially extends in a direction perpendicular to said front face.

* * * * *